United States Patent [19]

Kusta

[11] Patent Number: 4,982,864

[45] Date of Patent: Jan. 8, 1991

[54] SEAL RING FOR OPEN HEAD DRUM

[75] Inventor: Fred A. Kusta, Birmingham, Ala.

[73] Assignee: Self Manufacturing Company, Birmingham, Ala.

[21] Appl. No.: 475,746

[22] Filed: Feb. 6, 1990

[51] Int. Cl.[5] ..... B65D 45/32

[52] U.S. Cl. ..... 220/320; 215/275; 292/256.67

[58] Field of Search ..... 220/320:319, 321, 378; 215/274, 275, 280; 292/256.6, 256.67

[56] References Cited

U.S. PATENT DOCUMENTS

| | | | |
|---|---|---|---|
| 2,625,295 | 1/1953 | Easterday | 292/256.67 |
| 2,680,536 | 6/1954 | Kojan | 220/321 |
| 2,915,330 | 12/1959 | Verbiar | 292/256.67 |
| 2,968,508 | 1/1961 | Campbell et al. | 292/256.67 |
| 3,346,139 | 10/1967 | Armstrong, Jr. | 220/320 |
| 3,447,825 | 6/1969 | Santoni | 292/256.67 |
| 4,076,291 | 2/1978 | Pope et al. | 292/256.67 |
| 4,200,316 | 4/1980 | Kennedy | 292/256.6 |

FOREIGN PATENT DOCUMENTS

| | | | |
|---|---|---|---|
| 145808 | 6/1931 | Fed. Rep. of Germany | 220/320 |
| 904685 | 8/1962 | United Kingdom | 220/320 |

*Primary Examiner*—Stephen Marcus
*Assistant Examiner*—Stephen K. Cronin
*Attorney, Agent, or Firm*—Jennings, Carter, Thompson and Veal

[57] ABSTRACT

A closure ring for use with an open head drum utilizes a reduced diameter portion proximal each end thereof to increase the force required to draw the end of the ring together about the drum head and an associated lid and gasket, thereby increasing the compressive force applied to the gasket in the reduced diameter region resulting in greater sealing effect at the junction of the ring ends.

13 Claims, 1 Drawing Sheet

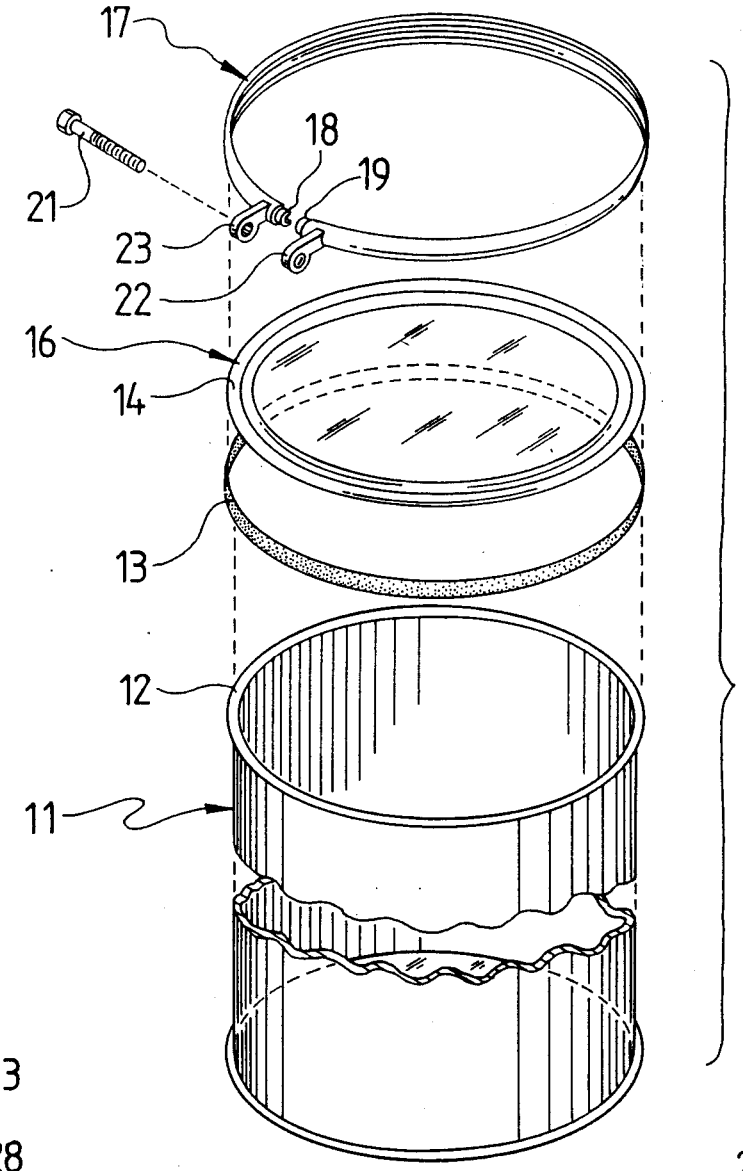
FIG. 1
FIG. 3
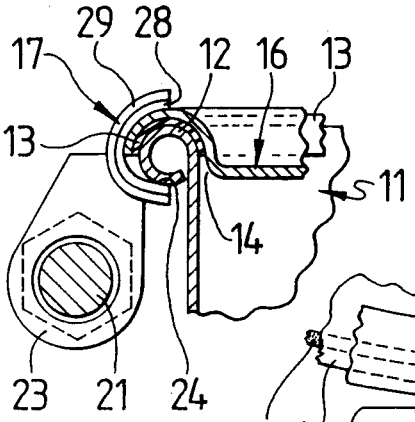
FIG. 2
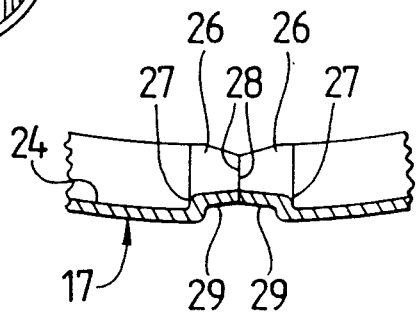
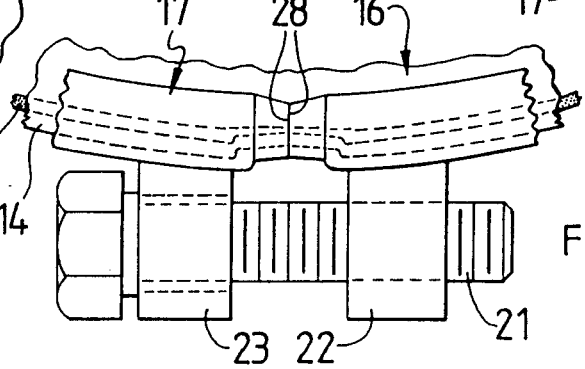
FIG. 4

SEAL RING FOR OPEN HEAD DRUM

FIELD OF THE INVENTION

The present invention relates to the field of reusable containers and more specifically to reusable drums commonly known as open head drums. More particularly the present invention relates to an improvement in sealing open head drums and in even greater particularity relates to an improvement in the closure ring used to secure a lid to an open head drum.

BACKGROUND OF THE INVENTION

Open head drums are commonly used as storage and transportation containers in many industries in the U.S. and Europe. Such drums are relatively easy to clean or recondition and thus are generally reusable. One problem that open head drums have is the difficulty in forming a proper seal about the top of the drum. Typically, open head drums have an outwardly rolled upper edge which is engaged by a lid which has an annular seat formed thereon. The seat rests atop a gasket intermediate the drum and the lid. A closure ring is placed over the lid and drum rim and tightened to maintain the sealing pressure on the gasket. The closure ring is a split ring which is secured on the drum head by one of various means for urging the ends of the ring toward each other. The weakness in the seal lies at the junction of the split ring. Open head drums must undergo drop tests wherein the drums are dropped from a height of at least four feet. The internal and external forces generated by the sudden deceleration upon impact typically cause leakage at the junction. Prior attempts to alleviate the problem have been to reinforce the lid at the junction as in U.S. Pat. No. 4,646,931 or to place a protective cover over the junction as in U.S. Pat. No. 3,587,700. Neither attempt has been successful; therefore, this attempt attacks the problem differently. There remains a need for a closure ring which reduces the vulnerability of the seal at the ring junction.

SUMMARY OF THE INVENTION

It is the object of the present invention to reduce the vulnerability of open head drums to leaks in the seal formed between the drums and the lids thereof.

A further object of the invention is to prevent leakage of a sealed open head drum subjected to a drop test.

Each of the foregoing objects is to further the principal object of improving the reliability and usefulness of open head drums as sealed containers.

Each of the foregoing objects and other advantages are accomplished in my invention which applies greater pressure to the lid and gasket at the end of the split ring thereby improving the seal in the region of the junction. The mechanism used to accomplish this improved seal is a reduced diameter region at each of the split ends. As the ends are urged together greater radial pressure must be applied to the lid to reduce the separation between the ends, therefore the force applied to the lid and gasket is increased.

BRIEF DESCRIPTION OF THE DRAWINGS

A sealing ring embodying the features of my invention is depicted in the accompanying drawing which form a portion of this disclosure and wherein:

FIG. 1 is a perspective exploded view of an open head, drum, lid, gasket, and closure ring;

FIG. 2 is a sectional view of the closure ring taken through the end portion;

FIG. 3 is an end view of the closure ring taken along the split of the ring; and FIG. 4 is a partial top view of the closure ring.

DESCRIPTION OF THE PREFERRED EMBODIMENT

Referring to the drawings for a clearer understanding of my invention it may be seen from FIG. 1 that an open head drum 11 has an upper peripheral edge 12 which may be formed into an outwardly rolled rim. A compressible gasket 13 is typically placed between the upper edge 12 and a downwardly opening annular seat 14 formed in a lid 16. When a drum 11 is to be sealed, normally the lid 16 will be urged into position by a fluid activated ram which compresses the gasket 13 as it seats the lid 16 on the drum. The lid 16 is then secured by a closure ring 17.

My improved closure ring 17 is a split ring having a first end 18 and a second end 19, the ends are normally connected by a threaded bolt 21 which engages a threaded eye 22 on one end and passes through an unthreaded eye 23 on the other and such that rotation of the threaded bolt 21 draws the two ends toward abutment. It will be understood by those familiar with the art that various other means may be used to draw the ends together.

My ring forms an inwardly opening receptacle into which the upper edge 12, seat 14, and gasket 13 may be received. Typically the receptacle forms a concave surface 24, the inner diameter of which is equal to or substantially equal to the outer diameter of the lid 16, except in my invention, a reduced diameter portion 26 is formed proximal each end of the split ring. The reduced diameter portion is a radially inwardly extending protrusion which forms a shoulder 27 transverse to the concave surface such that the protrusions formed on each end form a pair of paralleled shoulders 28 where the ends abut. Each reduced diameter portion 26 also has a conical surface 29 extending from the shoulder 27 to the terminal end of the ring, thus forming a minimum diameter at the adjacent ends of the split ring.

It will be appreciated by those familiar with the art that, when a conventional ring is drawn tightly about the drum and lid, substantially uniform forces are applied to the lid except at the adjacent ends of the ring, where the force is somewhat less than at other points about the ring. With my invention, as the ring is urged into a closed position the inward projection at each end must be overcome to tighten the ring, thus applying greater pressure at the adjacent ends of the ring than at other points about the ring. This pressure serves to hold the lid more firmly against the gasket in the region thus insuring the compression of the gasket and hence its resistance to leak. Therefore, when the drum is subjected to stresses, such as during the drop test, the path of least resistance to fluid escape through the junction of the ring is eliminated by the compressed gasket beneath the reduced diameter portion of the ring.

While I have shown my invention in one form, it will be obvious to those skilled in the art that it is not so limited but is susceptible of various changes and modifications without departing from the spirit thereof.

What I claim is:

1. An improved ring for securing and sealing a lid to an open head drum, said open head drum having an outwardly extending upper edge and said lid having an annular seat formed thereon for engagement on said upper edge, said annular seat holding a compressible gasket in position on said upper edge to form a seal, said improved ring comprising, a circular member split on one radian thereof to form a pair of adjacent ends, said circular member having a concave inner surface for encasing the outer peripheral portion of said lid and said upper edge of said open head drum and means for urging said adjacent ends toward each other, each end of said pair of adjacent ends having a radially projecting reduced diameter portion.

2. An improved ring as defined in claim 1 wherein said concave inner surface has an average diameter substantially equal to or less than the outer diameter of said lid.

3. An improved ring as defined in claim 2 wherein said reduced diameter portion of each end of said pair of adjacent ends forms an inwardly projecting shoulder transversely of said concave surface.

4. An improved ring as defined in claim 3 wherein said reduced diameter portion includes a semi-conical surface tapering from said inwardly projecting shoulder toward the end of said circular member to form a minimum diameter at the end of said circular member.

5. An improved ring as defined in claim 2 wherein said reduced diameter portion includes a semi-conical surface tapering toward the end of said circular member forming a minimum diameter at the end of said circular member.

6. A ring for sealing a lid to an open headed drum or the like wherein said open headed drum has an outwardly rolled upper edge and said lid has an annular seat formed thereon to rest on said upper edge with an annular gasket intermediate to said lid and open headed drum, with said ring comprising a substantially split ring having a first end and a second end with a means for securing said ends to one another, and an inwardly opening groove extending substantially the length of said split ring for receiving said lid, said annular gasket, and said rolled upper edge of said open headed drum therein, and a radially inwardly extending protrusion formed on said groove proximal said first end and a second radially inwardly extending protrusion formed proximal said second end, said protrusions forming parallel shoulders when said first and second ends are abutted.

7. A ring for sealing as defined in claim 6 wherein said first and second protrusions are radial ribs which are perpendicular to said ring for sealing, said ribs being conical on their inner surfaces having a minimum diameter at said first and second end.

8. A sealing ring for use with an open top drum or the like said open top drum having an outwardly rolled upper edge, a lid having an annular portion adapted for engagement with at least part of the upper surface of said rolled upper edge and an annular gasket for sealing said drum and lid said sealing ring comprising a split ring having an inner diameter sufficient to permit it to encircle said upper edge and gasket, and forming a radially inwardly opening retainer for said upper edge, lid and gasket, said split ring having a reduced diameter portion proximal each end thereof and means for urging said ends of said ring toward an abutting relationship encircling said upper edge, lid, and gasket whereby said gasket undergoes maximum compression in the region beneath said reduced diameter portion.

9. A sealing ring as defined in claim 8 wherein said reduced diameter portion includes a semi-conical surface tapering toward the end of said circular member to form a minimum diameter at the end of said circular member.

10. A sealing ring as in claim 8 wherein said split ring has a concave inner surface.

11. A sealing ring as defined in claim 10 wherein said concave inner surface has an average diameter substantially equal to or less than the outer diameter of said lid.

12. A sealing ring as defined in claim 11 wherein said reduced diameter portion of each end forms an inwardly projecting shoulder transversely of said concave surface.

13. A sealing ring as defined in claim 12 wherein said reduced diameter portion includes a semi-conical surface tapering from said inwardly projecting shoulder toward the end of said circular member to form a minimum diameter at the end of said circular member.

* * * * *